US007667597B2

(12) United States Patent
Fellows et al.

(10) Patent No.: US 7,667,597 B2
(45) Date of Patent: Feb. 23, 2010

(54) METHOD AND APPARATUS USING MAGNETIC FLUX FOR CONTAINER SECURITY

(75) Inventors: Richard L. Fellows, Pleasanton, CA (US); Timothy K. Brand, Cupertino, CA (US)

(73) Assignee: Savi Technology, Inc., Mountain View, CA (US)

( * ) Notice: Subject to any disclaimer, the term of this patent is extended or adjusted under 35 U.S.C. 154(b) by 329 days.

(21) Appl. No.: 11/848,889

(22) Filed: Aug. 31, 2007

(65) Prior Publication Data

US 2008/0218353 A1 Sep. 11, 2008

Related U.S. Application Data

(60) Provisional application No. 60/906,051, filed on Mar. 9, 2007.

(51) Int. Cl.
*G08B 13/08* (2006.01)

(52) U.S. Cl. ..... 340/545.6; 340/541; 340/547; 340/551; 340/561

(58) Field of Classification Search ..... 340/545.6, 340/541, 545.2, 547, 551, 561
See application file for complete search history.

(56) References Cited

U.S. PATENT DOCUMENTS

| | | | |
|---|---|---|---|
| 3,561,634 | A | 2/1971 | Meldrum |
| 3,597,753 | A | 8/1971 | Tabankin |
| 3,665,449 | A | 5/1972 | Elder et al. |
| 3,848,243 | A | 11/1974 | Schirmer |
| 3,878,539 | A | 4/1975 | Gooding |
| 3,961,323 | A | 6/1976 | Hartkorn |
| 4,074,184 | A | 2/1978 | Dechene et al. |
| 4,258,359 | A | 3/1981 | McLamb |

(Continued)

FOREIGN PATENT DOCUMENTS

EP 0 467 036 A2 1/1992

(Continued)

OTHER PUBLICATIONS

Roderick E. Thorne, Philip J. Keleshian, Timothy R. Redler, Joseph S.Chan and Nikola Cargonja, U.S. Appl. No. 60/332,480, filed Nov. 9, 2001 for "Method and Apparatus for Providing Container Security with a Tag".

(Continued)

*Primary Examiner*—Travis R Hunnings
(74) *Attorney, Agent, or Firm*—Haynes and Boone, LLP

(57) ABSTRACT

A seal device includes a locking member with a magnetically permeable material portion, and structure that can receive the locking member. The structure supports a magnetic field generator and detector at locations spaced from each other and from a region that is occupied by the portion of the locking member when the locking member is received by the structure. The structure defines a main flux path as a loop having a first portion, a second portion and a remainder that are mutually exclusive, and that collectively define the entirety of the flux path. The first and second portions are respectively within the magnetic field generator and the region, and most of the remainder extends through magnetically permeable material of the structure. The detector is located where the magnetic field has different characteristics when the portion of the locking member is respectively present in and absent from the region.

18 Claims, 2 Drawing Sheets

U.S. PATENT DOCUMENTS

| | | | | |
|---|---|---|---|---|
| 4,287,512 | A * | 9/1981 | Combs | 340/542 |
| 4,438,428 | A | 3/1984 | Ober et al. | |
| 4,484,181 | A | 11/1984 | Schwartz | |
| 4,683,461 | A | 7/1987 | Torre | |
| 4,688,244 | A | 8/1987 | Hannon et al. | |
| 4,808,974 | A | 2/1989 | Cantley | |
| 5,072,212 | A | 12/1991 | Sorenson | |
| 5,247,279 | A | 9/1993 | Sato | |
| 5,341,123 | A | 8/1994 | Schuman, Sr. et al. | |
| 5,410,899 | A | 5/1995 | McConnell | |
| 5,422,627 | A | 6/1995 | Tap et al. | |
| 5,448,220 | A | 9/1995 | Levy | |
| 5,479,152 | A | 12/1995 | Walker et al. | |
| 5,499,014 | A | 3/1996 | Greenwaldt | |
| 5,568,951 | A | 10/1996 | Morgan | |
| 5,572,191 | A | 11/1996 | Lundberg | |
| 5,615,247 | A | 3/1997 | Mills | |
| 5,646,592 | A | 7/1997 | Tuttle | |
| 5,656,996 | A | 8/1997 | Houser | |
| 5,729,199 | A | 3/1998 | Cooper et al. | |
| 5,735,495 | A | 4/1998 | Kubota | |
| 5,804,810 | A | 9/1998 | Woolley et al. | |
| 5,844,482 | A | 12/1998 | Guthrie et al. | |
| 5,887,176 | A | 3/1999 | Griffith et al. | |
| 5,907,812 | A | 5/1999 | Van De Berg | |
| 5,913,180 | A | 6/1999 | Ryan | |
| 5,917,433 | A | 6/1999 | Keillor et al. | |
| 5,936,523 | A | 8/1999 | West | |
| 5,939,982 | A | 8/1999 | Gagnon et al. | |
| 5,959,568 | A | 9/1999 | Woolley | |
| 5,999,091 | A | 12/1999 | Wortham | |
| 6,204,764 | B1 | 3/2001 | Maloney | |
| 6,236,911 | B1 | 5/2001 | Kruger | |
| 6,265,973 | B1 | 7/2001 | Brammall et al. | |
| 6,271,753 | B1 | 8/2001 | Shukla | |
| 6,274,856 | B1 | 8/2001 | Clothier et al. | |
| 6,281,793 | B1 | 8/2001 | Haimovich et al. | |
| 6,285,282 | B1 | 9/2001 | Dorenbosch et al. | |
| 6,346,886 | B1 | 2/2002 | De La Huerga | |
| 6,407,666 | B1 | 6/2002 | Debrody et al. | |
| 6,444,961 | B2 | 9/2002 | Clothier et al. | |
| 6,483,473 | B1 | 11/2002 | King et al. | |
| 6,497,656 | B1 | 12/2002 | Evans et al. | |
| 6,512,455 | B2 | 1/2003 | Finn et al. | |
| 6,608,554 | B2 | 8/2003 | Lesesky et al. | |
| 6,736,316 | B2 | 5/2004 | Neumark | |
| 6,744,352 | B2 | 6/2004 | Lesesky et al. | |
| 6,747,558 | B1 * | 6/2004 | Thorne et al. | 340/551 |
| 6,748,292 | B2 | 6/2004 | Mountz | |
| 6,753,775 | B2 | 6/2004 | Auerbach et al. | |
| 6,796,142 | B2 | 9/2004 | Burn | |
| 6,830,181 | B1 | 12/2004 | Bennett | |
| 6,844,829 | B2 | 1/2005 | Mayor | |
| 6,919,803 | B2 | 7/2005 | Breed | |
| 6,975,224 | B2 | 12/2005 | Galley, III et al. | |
| 7,023,348 | B2 | 4/2006 | Hogan et al. | |
| 7,034,683 | B2 | 4/2006 | Ghazarian | |
| 7,042,354 | B2 | 5/2006 | Auerbach et al. | |
| 7,091,864 | B2 | 8/2006 | Veitch et al. | |
| 7,098,784 | B2 | 8/2006 | Easley et al. | |
| 7,132,926 | B2 | 11/2006 | Vaseloff et al. | |
| 7,242,296 | B2 | 7/2007 | Wang et al. | |
| 7,317,387 | B1 | 1/2008 | Cova et al. | |
| 7,321,308 | B1 | 1/2008 | Feibelman | |
| 7,333,019 | B2 | 2/2008 | Redler et al. | |
| 7,406,439 | B2 | 7/2008 | Bodin et al. | |
| 7,417,543 | B2 * | 8/2008 | Bergman et al. | 340/545.6 |
| 7,579,948 | B2 * | 8/2009 | Bohman et al. | 340/545.6 |
| 2003/0227392 | A1 | 12/2003 | Ebert et al. | |
| 2004/0012502 | A1 | 1/2004 | Rasmussen | |
| 2004/0069850 | A1 | 4/2004 | De Wilde | |
| 2004/0119588 | A1 | 6/2004 | Marks | |
| 2004/0174259 | A1 | 9/2004 | Peel et al. | |
| 2004/0183673 | A1 | 9/2004 | Nageli | |
| 2004/0226800 | A1 | 11/2004 | Pierga et al. | |
| 2004/0233041 | A1 | 11/2004 | Bohman et al. | |
| 2004/0263329 | A1 | 12/2004 | Cargonja et al. | |
| 2005/0134457 | A1 | 6/2005 | Rajapakse et al. | |
| 2005/0151643 | A1 | 7/2005 | Rajapakse et al. | |
| 2006/0012481 | A1 | 1/2006 | Rajapakse et al. | |
| 2006/0290496 | A1 | 12/2006 | Peeters | |
| 2007/0008107 | A1 | 1/2007 | Farrell et al. | |
| 2007/0096904 | A1 | 5/2007 | Lockyer et al. | |
| 2007/0096920 | A1 | 5/2007 | Cargonja et al. | |
| 2009/0102649 | A1 * | 4/2009 | Diener et al. | 340/542 |
| 2009/0102657 | A1 * | 4/2009 | Evans et al. | 340/572.1 |
| 2009/0102658 | A1 * | 4/2009 | Evans et al. | 340/572.1 |
| 2009/0102659 | A1 * | 4/2009 | Evans et al. | 340/572.1 |
| 2009/0102660 | A1 * | 4/2009 | Evans et al. | 340/572.1 |

FOREIGN PATENT DOCUMENTS

| | | |
|---|---|---|
| EP | 0 825 554 A1 | 2/1998 |
| EP | 0 984 400 A2 | 3/2000 |
| WO | WO 98 / 32092 | 7/1998 |
| WO | WO 01 / 08116 | 2/2001 |
| WO | WO 01 /27891 | 4/2001 |

OTHER PUBLICATIONS

Nikola Cargonja, Philip J. Keleshian, Roderick E. Thorne and Steven J. Farrell, U.S. Appl. No. 60/464,067, filed Apr. 18, 2003 for "Techniques for Detecting Intrusion Into a Cargo Container".

Nikola Cargonja, Philip J. Keleshian, Roderick E. Thorne and Ravindra U. Rajapakse, U.S. Appl. No. 60/496,056, filed Aug. 18, 2003 for "Technique Using Cargo Container Motion as a Factor in Intrusion Detection".

Gustavo Padilla and Roderick E. Thorne, U.S. Appl. No. 60/504,580, filed Sep. 19, 2003 for "Technique Using Cargo Container Door Sensor as a Factor In Intrusion Detection".

Nicholas D. Cova, Mark S. Weidick, and Blair B. LaCorte, U.S. Appl. No. 60/518,553, filed Nov. 7, 2003 for "Method and Apparatus for Increased Container Security".

Ravindra U. Rajapakse, Roderick E. Thorne, Robert Fraser Jennings, Steven J. Farrell and Liping Julia Zhu, U.S. Appl. No. 60/588,229, filed Jul. 15, 2004 for "Method And Apparatus for Effecting Control or Monitoring Within a Container".

Ravindra U. Rajapakse, Steven J. Farrell, Nicholas D. Cova, Mark S. Weidick, Roderick E. Thorne and Gustavo Padilla, U.S. Appl. No. 60/514,968, filed Oct. 27, 2003 for "Mechanisms for Secure RF Tags on Containers".

Richard D. Lockyer, U.S. Appl. No. 60/732,240, filed Nov. 1, 2005 for "Apparatus and Method for Capacitive Sensing of Door Position".

Fraden, Jacob, "Handbook of Modern Sensors: Physics, Designs, and Applications," Second Edition, 1997, 3 title pages and pp. 250-253, AIP Press, Woodbury, NY.

* cited by examiner

METHOD AND APPARATUS USING MAGNETIC FLUX FOR CONTAINER SECURITY

This application claims the priority under 35 U.S.C. §119 of provisional application No. 60/906,051 filed Mar. 9, 2007.

FIELD OF THE INVENTION

This invention relates in general to security for containers that can hold one or more items and, more particularly, to a method and apparatus for sealing such containers.

BACKGROUND

One common use for containers is the shipment of goods from one location to another. Goods are packed into the container, and a door of the container is closed and latched. Then, the container is transported to a destination by one or more vehicles, such as trucks, planes, trains and/or ships. At the destination, the container door is unlatched and opened, and the goods are removed.

The transportation industry has recognized that it is important to provide security for the goods being transported in such containers. As one aspect of this, there is a need to prevent goods from being removed from a container while it is in transit to its destination, even if the container itself is not stolen, misrouted or misplaced. There is also a need to prevent someone from opening the container and inserting some additional item, such as a bomb.

For this purpose, there are existing seal devices that are used to seal or lock the latch mechanism for the door of the container. The most common type of seal device has a disposable bolt and a reusable housing. The bolt is inserted through the latching mechanism of the container, and the reusable housing is then pressed onto an end of the bolt. The bolt and housing have cooperating structure that completely prevents withdrawal of the end of the bolt from the housing in a direction opposite to its insertion direction. To remove this seal device from a container, the disposable bolt must be cut with a bolt cutter.

Some seal devices of this type also include radio frequency identification (RFID) tag circuitry. If the circuitry detects any form of tampering with the seal device, the circuitry transmits a wireless signal that contains information indicative of the tampering. While seal devices of this type have been generally adequate for their intended purposes, they have not been satisfactory in all respects.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
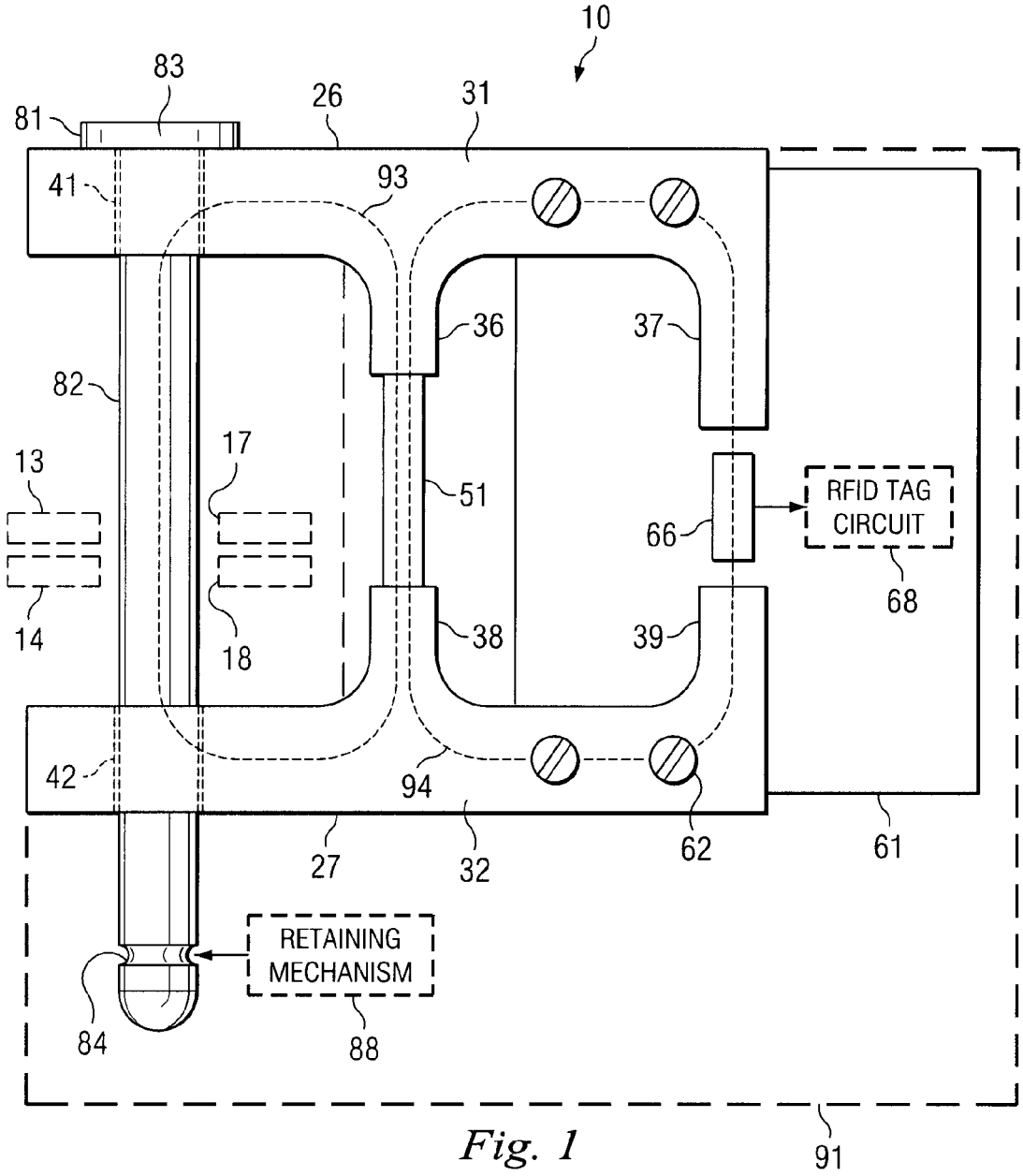
FIG. 1 is a diagrammatic side view of a seal device that embodies aspects of the invention, and that is used to seal or lock the latch mechanism for the door of a shipping container.

FIG. 1 is a diagrammatic side view of an apparatus in the form of a seal device 10 that embodies aspects of the invention, and that is used to seal or lock the latch mechanism for the door of a shipping container. Two parts of a container latch mechanism are shown diagrammatically in broken lines at 13 and 14. The container and its latch mechanism are entirely conventional. Therefore, the parts 13 and 14 of the latch mechanism are not illustrated and described here in detail, but instead are discussed only briefly, to facilitate an understanding of the invention. The parts 13 and 14 have respective cylindrical openings 17 and 18 therethrough, which are coaxially aligned with each other in FIG. 1. The seal device 10 prevents relative movement of the parts 13 and 14 in a horizontal direction in FIG. 1, as evident from the discussion that follows.

The seal device 10 includes two spaced metal parts 26 and 27 that have a high magnetic permeability, and that are fixed against movement with respect to each other. In the disclosed embodiment, the parts 26 and 27 are each made of steel, but they could alternatively be made of any other suitable material. The parts 26 and 27 each have approximately the shape of the letter "F". In this regard, the parts 26 and 27 have respective main portions 31 and 32 that extend parallel to each other. The part 26 has two spaced and parallel projections 36 and 37 that extend outwardly from the main portion 31 approximately perpendicular thereto, in a direction toward the part 27. Similarly, the part 27 has two spaced and parallel projections 38 and 39 that extend outwardly from the main portion 32 approximately perpendicular thereto, in a direction toward the part 26.

The projection 37 is located at one end of the main portion 31, and the projection 39 is located at one end of the main portion 32. The projections 37 and 39 are aligned with each other, and have a space between their outer ends. The projection 36 is provided at a location approximately halfway along the length of the main portion 31, and the projection 38 is provided at a location approximately halfway along the length of the main portion 32. The projections 36 and 38 are aligned with each other, and have a space between their outer ends. The main portion 31 has a cylindrical opening 41 extending therethrough near an end remote from the projection 37, in a direction approximately parallel to the projections 36 and 37. The main portion 32 has a cylindrical opening 42 extending therethrough near an end remote from the projection 39, in a direction approximately parallel to the projections 38 and 39. The cylindrical openings 41 and 41 are coaxially aligned.

A permanent magnet 51 is disposed between and engages the outer ends of the projections 36 and 38. The magnet 51 serves as magnetic field generator. A circuit board 61 is fixedly coupled to each of the parts 26 and 27 by several screws or bolts, one of which is identified by reference numeral 62. A magnetic field detector 66 is supported on the circuit board 61, at a location between the ends of the projections 37 and 39 on the parts 26 and 27. In the disclosed embodiment, the detector 66 is a Hall effect sensor, but it could alternatively be any other type of suitable detector, one example of which is a magnetoresistive sensor. A radio frequency identification (RFID) tag circuit 68 is also provided on the circuit board 61, and is responsive to the output of the Hall effect sensor 66. The tag circuit 68 is a type of circuit that is well known in the art, and it is therefore not described here in detail. The tag circuit 68 includes a not-illustrated transceiver that can send and receive wireless signals.

The seal device 10 further includes a seal bolt 81 that is magnetically permeable, that has an elongate cylindrical shank 82, and that has a circular head 83 at one end of the shank, the head 83 having a diameter greater than the diameter of the shank 82. A circumferential groove 84 is provided in the shank 82, near an end remote from the head 83. In the disclosed embodiment, the bolt is made of steel, but it could alternatively be made of any other suitable material(s) of high magnetic permeability. In FIG. 1, the shank 82 of the bolt 81 extends through the aligned openings 41 and 42 in the parts 26 and 27, and also extends through the aligned openings 17 and 18 in the latch parts 13 and 14.

The seal device 10 includes a retaining mechanism 88. The retaining mechanism 88 is known in the art, and is therefore not described here in detail. When the shank 82 of the bolt 81 has been inserted successively through the openings 41, 17, 18 and 42, and reaches the position shown in FIG. 1, the retaining mechanism 88 engages the circumferential groove 84, and fixedly holds the bolt 81 against upward movement in FIG. 1. That is, the bolt cannot be withdrawn in an upward direction from the openings 41 and 42 in the parts 26 and 27 of the seal device 10. The only way to disengage the seal device 10 from the latch parts 13 and 14 of a container is to intentionally cut the shank 82 of the bolt at a location between the parts 26 and 27.

The seal device 10 has a housing 91 that is indicated diagrammatically by a broken line. The housing 91 encloses the retaining mechanism 88, the circuit board 61, the magnet 51, and portions of the parts 26 and 27. The permanent magnet 51 produces a magnetic field, and the magnetic flux of this field will follow the path of lowest reluctance. More specifically, when the bolt 81 is installed and intact, as shown in FIG. 1, the path of lowest reluctance for the magnetic flux is indicated diagrammatically by a broken line 93. It extends from the upper end of the magnet 51 though the part 26 to the bolt 81, through the shank 82 of the bolt to the part 27, and through the part 27 to the lower end of the magnet 51. On the other hand, if the bolt 81 is cut in the region of the latch parts 13 and 14, and the portion thereof with the head 83 is withdrawn, the path 93 will no longer be the path of lowest reluctance. Instead, the path of lowest reluctance will be that indicated diagrammatically by a broken line 94. This path extends from the upper end of the magnet 51 through the part 26 to the end of projection 37, across the small gap between the projections 37 and 39 and thus past the Hall effect sensor 66, and then through the part 27 to the lower end of the magnet 51.

In essence, when the bolt 81 is installed and intact, as shown in FIG. 1, its shank 82 serves as a form of magnetic shunt for the flux from the magnet 51, such that the flux is shunted through the bolt rather than being routed past the sensor 66. In contrast, when the bolt 82 is cut and is no longer able to serve as a shunt, the magnetic flux is routed past the Hall effect sensor 66. Thus, when the bolt 81 is installed and intact, as shown in FIG. 1, there will be a relatively low level of magnetic flux in the region of the Hall effect sensor 66. In contrast, if the bolt is cut and a portion of the bolt is removed, there will be an increase in the level of magnetic flux at the Hall effect sensor 66. The Hall effect sensor 66 can detect a change in magnetic flux, and then change its output signal. The change in the output signal of the sensor 66 will tell the tag circuit 68 that the bolt 82 has apparently been cut. If the container bearing the seal device 10 has reached its destination and is in the process of being opened, then this is normal. But if the container is still in transit and the seal device 10 should still be intact, then it is likely that a thief has cut the bolt 81 in order the remove the seal device 10 and gain unauthorized access to the interior of the container. Accordingly, the tag circuit 68 will transmit a wireless signal containing an indication that the seal device 10 has apparently experienced some form of tampering.

Figure 2:
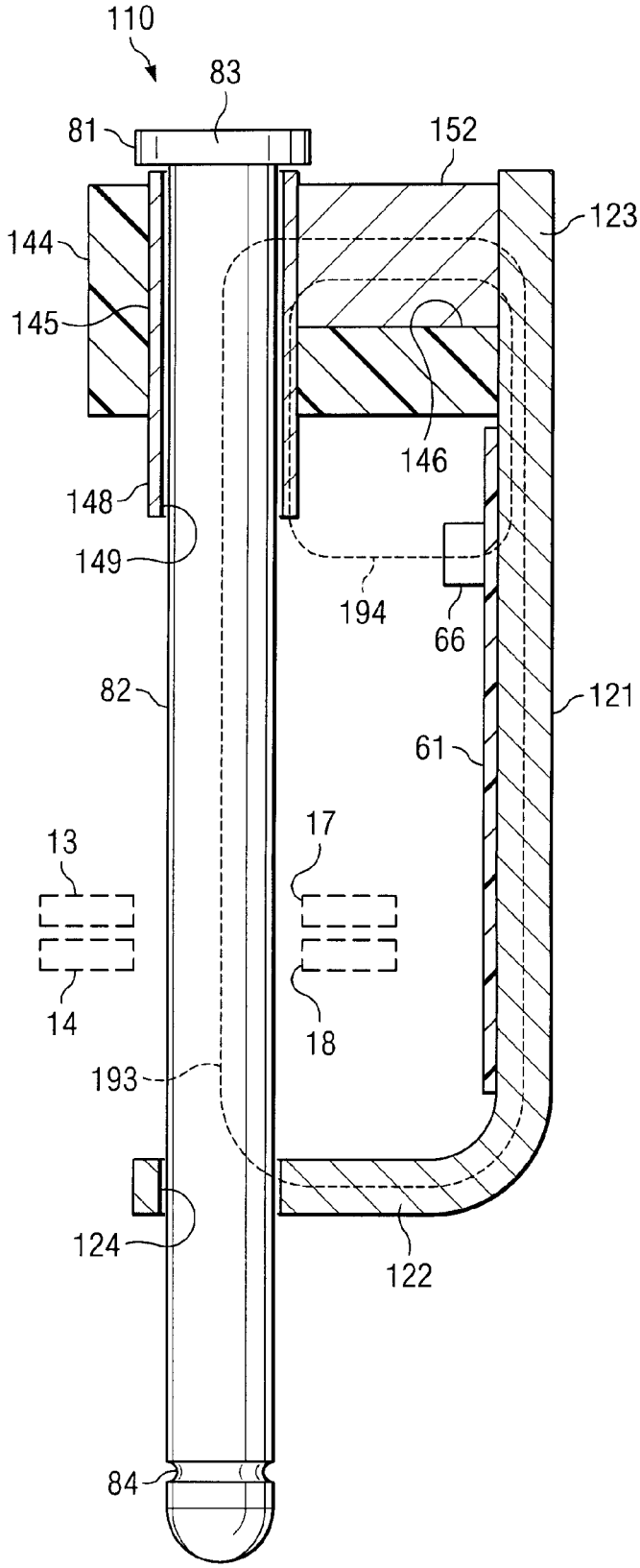
FIG. 2 is a diagrammatic sectional side view of a seal device that embodies aspects of the invention, and that is an alternative embodiment of the seal device of FIG. 1.

FIG. 2 is a diagrammatic sectional side view of a seal device 110 that embodies aspects of the invention, and that is an alternative embodiment of the seal device 10 of FIG. 1. Components in FIG. 2 that are identical or equivalent to components in FIG. 1 are identified with the same reference numerals in both drawing figures. For convenience and clarity, some portions of the seal device 110 have been omitted in FIG. 2. For example, the seal device 110 includes a housing and a retaining mechanism that are comparable to the housing 91 and retaining mechanism 88 in the seal device 10 of FIG. 1, but the housing and retaining mechanism of the seal device 110 have intentionally been omitted from FIG. 2.

The seal device 110 includes an L-shaped part 121 that is magnetically permeable, and that has two legs 122 and 123 extending approximately perpendicular to each other. In the disclosed embodiment, the part 121 is made of steel, but it could alternatively be made of any other suitable material. A cylindrical opening 124 extends through the leg 122, near an outer end thereof.

The seal device 110 includes a block 144 that is made from an electrically insulating material. In the disclosed embodiment, the block 144 is made from a rigid and durable plastic material, but it could alternatively be made from any other suitable material. The block 144 is fixedly coupled to an outer end of the leg 123 of the part 121, for example by a plurality of screws or bolts that are not visible in FIG. 2. However, the block 144 could be coupled to the part 121 in any other suitable manner. The block 144 has a cylindrical opening 145 extending therethrough, at a location spaced outwardly from the leg 123 of the part 121. The opening 145 is coaxially aligned with the opening 124 through the leg 122 of the part 121. The block 144 also has a recess 146 in one side thereof. The recess 146 extends from the opening 145 to the leg 123 of the part 121.

A cylindrical metal sleeve 148 is disposed within the opening 145 in the block 144. The outside diameter of the sleeve 148 is approximately equal to the inside diameter of the opening 145, such that the sleeve 148 is held within the opening 145 by a force fit. The sleeve 148 is also fixedly held in the opening 145 by a suitable adhesive, such as a commercially-available epoxy adhesive. The sleeve 148 could alternatively be held against axial movement in any other suitable manner. The sleeve 148 is made of a magnetically permeable material. In the disclosed embodiment, the sleeve 148 is made of steel, but it could alternatively be made of any other suitable material. The central cylindrical opening 149 through the sleeve is coaxially aligned with the opening 124 in the leg 122 of the part 121.

A permanent magnet 152 is disposed within the recess 146. In the disclosed embodiment, the magnet 152 is held in place by a known epoxy adhesive, but it could alternatively be held in place in any other suitable manner. One end of the magnet 152 contacts the sleeve 148, and the other end of magnet 152 contacts the leg 123 of the part 121. The circuit board 61 with the Hall effect sensor 66 thereon is fixedly supported on the leg 123 of the part 121, for example by two or more bolts that are not visible in FIG. 2. The sensor 66 is disposed at a location where, in FIG. 2, it is approximately vertically aligned with the lower end of the sleeve 148.

The shank 82 of the bolt 81 can be inserted through the central opening 149 in the sleeve 148, through the aligned openings 17 and 18 in the latch parts 13 and 14, and through the opening 124 in the leg 122 of part 121, until the head 83 of the bolt is engaging the upper end of the sleeve 148. In this position of the bolt, the not-illustrated retaining mechanism cooperates with the groove 84 to prevent withdrawal of the bolt in an upward direction.

When the bolt 81 is installed and intact, as shown in FIG. 2, the path of lowest reluctance for the flux generated by the magnet 152 is the path indicated diagrammatically by a broken line 193. This path extends from the magnet 152 through the sleeve 148 to the shank 82 of bolt 81, along the shank to the part 121, and then through the legs 122 and 123 of part 121 to the magnet 152. On the other hand, if the bolt 82 is cut in the region of the latch parts 13 and 14, and if the upper portion of the bolt is removed, then the path of least reluctance for the magnetic flux would be that indicated diagrammatically by a broken line 194. This path extends from the magnet 152 through the sleeve 148 to the lower end of the sleeve, then across the gap between the sleeve 148 and the leg 123 past the Hall effect sensor 66, and then through the leg 123 to the magnet 152. Thus, in the event the bolt is cut and its upper part is removed, the magnetic flux in the region of the Hall effect sensor 66 will change. The Hall effect sensor 66 can detect this change in flux, and then change its output signal. The change in the output signal of the sensor 66 will tell the not-illustrated tag circuit that the bolt 82 has apparently been cut.

In each of the disclosed embodiments, the static magnetic field produced by the permanent magnet is polarized. This increases the difficulty of defeating the seal device, because one would need to know the polarity of the magnetic field in order to attempt to introduce an external magnetic field that is properly polarized so as to mask the magnetic effect of cutting the bolt. Also, in each embodiment, portions of the flux paths that are not within the magnet, the bolt or the detector are virtually completely disposed within material having a high magnetic permeability. This reduces sensitivity of the seal device to external metal objects such as a container, as well as sensitivity to external magnetic fields.

Although selected embodiments have been illustrated and described in detail, it should be understood that a variety of substitutions and alterations are possible without departing from the spirit and scope of the present invention, as defined by the claims that follow.

What is claimed is:

1. An apparatus comprising a seal device that includes:

a locking member having a portion made of a magnetically permeable material;

a magnetic field generator for generating a magnetic field;

a magnetic field detector; and structure that can receive said locking member, said structure supporting said magnetic field generator and said magnetic field detector at locations spaced from each other and from a region that is respectively free of and occupied by said portion of said locking member respectively before and after said locking member is received by said structure, said structure defining a main flux path for said magnetic field, said flux path being a loop and having a first portion, a second portion and a remainder that are mutually exclusive, said remainder being the entirety of said flux path other than said first and second portions thereof, said structure including magnetically permeable material, said first portion of said flux path being within said magnetic field generator, said second portion of said flux path being within said region, and most of said remainder of said flux path extending through magnetically permeable material of said structure, said detector being disposed at a selected location where said magnetic field has different characteristics when said portion of said locking member is respectively present in and absent from said region.

2. An apparatus according to claim 1, wherein said detector is one of a Hall effect sensor and a magnetoresistive sensor.

3. An apparatus according to claim 1, wherein said structure defines a further flux path for said magnetic field that is different from said main flux path, said further flux path being a loop and having a first portion, a second portion and a remainder that are mutually exclusive, said remainder of said further flux path being the entirety thereof other than said first and second portions thereof, said first portion of said further flux path being within said magnetic field generator, and said second portion of said further flux path extending through said selected location; and wherein when said portion of said locking member is respectively present in and absent from said region, said main flux path respectively has a lower reluctance and a higher reluctance than said further flux path.

4. An apparatus according to claim 3, wherein said structure includes first and second parts that are made of magnetically permeable material, that are spaced from each other, and that respectively engage said portion of said locking member at spaced first and second locations thereon, said magnetic field generator being disposed between said first and second parts.

5. An apparatus according to claim 4, wherein said first and second parts have substantially all of said remainder of each said flux path extending therethrough.

6. An apparatus according to claim 4, wherein said detector is disposed between said first and second parts and is closely adjacent each of said first and second parts.

7. An apparatus according to claim 6, wherein said magnetic field generator is disposed between and spaced from each of said locking member and said detector, and includes a permanent magnet that is closely adjacent each of said first and second parts.

8. An apparatus according to claim 6, wherein said seal device includes a circuit board supported on said first and second parts and having circuitry thereon, said circuitry including said detector and being responsive to an output of said detector.

9. An apparatus according to claim 4, wherein said locking member is elongate and said first and second locations are spaced therealong;

wherein said first part is a sleeve that slidably receives said locking member; and wherein said second part is approximately L-shaped and has first and second legs, said first leg engaging said locking member at said second location, and said magnetic field generator being disposed between said sleeve and said second leg.

10. An apparatus according to claim 9, wherein said magnetic field generator includes a permanent magnet that is closely adjacent each of said first and second parts.

11. An apparatus according to claim 9, including an electrically insulating part that is disposed between and coupled to each of said second leg and said sleeve.

12. An apparatus according to claim 9, wherein said seal device includes a circuit board supported on said second leg and having circuitry thereon, said circuitry including said detector and being responsive to an output of said detector.

13. An apparatus according to claim 1, wherein said seal device includes circuitry, said circuitry including said detector, and said circuitry including a radio frequency identification section that is responsive to said detector and that is operable to transmit wireless signals.

14. A method of operating an apparatus that includes a seal device having a locking member with a portion made of a magnetically permeable material, and having structure that can receive said locking member and that has magnetically permeable material, said method comprising;

generating a magnetic field with a magnetic field generator disposed at a first location spaced from a region that is respectively free of and occupied by said portion of said locking member respectively before and after said locking member is received by said structure providing a main flux path for said magnetic field, said flux path being a loop and having a first portion, a second portion and a remainder that are mutually exclusive, said remainder being the entirety of said flux path other than said first and second portions thereof, said first portion of said flux path being within said magnetic field generator, said second portion of said flux path being within said region, and most of said remainder of said flux path extending through said magnetically permeable material of said structure; and detecting said magnetic field at a second location where said magnetic field has different characteristics when said portion of said locking member is respectively present in and absent from said region, said second location being spaced from each of said first location and said region.

15. A method according to claim 14, wherein said detecting is carried out with one of a Hall effect sensor and a magnetoresistive sensor.

16. A method according to claim 14, wherein said detecting is carried out with a detector disposed at said second location; and including providing radio frequency identification circuitry that is responsive to said detector, and that is operable to transmit transmit wireless signals.

17. A method according to claim 14, including selecting a permanent magnet to be said magnetic field generator.

18. A method according to claim 14, including providing a further flux path for said magnetic field that is different from said main flux path, said further flux path being a loop and having a first portion, a second portion and a remainder that are mutually exclusive, said remainder of said further flux path being the entirety thereof other than said first and second portions thereof, said first portion of said further flux path being within said magnetic field generator, and said second portion of said further flux path extending through said second location, wherein when said portion of said locking member is respectively present in and absent from said region, said main flux path respectively has a lower reluctance and a higher reluctance than said further flux path.

* * * * *